US005474420A

United States Patent [19]

Östberg

[11] Patent Number: 5,474,420

[45] Date of Patent: Dec. 12, 1995

[54] DUCT FAN HOUSING ASSEMBLY

[76] Inventor: Hans Östberg, Myrgatan 48, Avesta S-774 00, Sweden

[21] Appl. No.: 240,463

[22] Filed: May 10, 1994

[30] Foreign Application Priority Data

May 17, 1993 [SE] Sweden ..... 9301693

[51] Int. Cl.[6] ..... F04D 29/64

[52] U.S. Cl. ..... 415/214.1

[58] Field of Search ..... 415/142, 213.1, 415/214.1

[56] References Cited

U.S. PATENT DOCUMENTS

| | | | |
|---|---|---|---|
| 2,456,488 | 12/1948 | Brown | 415/214.1 |
| 2,805,615 | 9/1957 | Rudy | 415/214.1 X |
| 3,775,029 | 11/1973 | Ranz | 415/142 |
| 4,394,111 | 7/1983 | Wiese et al. | 415/214.1 |
| 4,867,640 | 9/1989 | Penlesky et al. | 415/214.1 |
| 5,030,061 | 7/1991 | Meissgeier | 415/214.1 |

FOREIGN PATENT DOCUMENTS

| | | | |
|---|---|---|---|
| 146944 | 9/1954 | Sweden | 415/214.1 X |

*Primary Examiner*—Edward K. Look
*Assistant Examiner*—Michael S. Lee
*Attorney, Agent, or Firm*—Young & Thompson

[57] ABSTRACT

A duct fan (1) comprises a fan housing (2) consisting of two components, an inlet component (3) and an outlet component (4), a motor bridge (5) placed within the housing, and a unit (6) consisting of a motor with impeller and attached to the motor bridge (5). The motor bridge (5), which is diametrically extended through the housing (2), is provided at its outer ends with lugs (16), which are received in impressions (9) in the edge portion (8) of the inlet component (3). The outlet component (4) is provided with an edge portion (12), which fits onto the edge portion (8) of the inlet component (3), and a shoulder (13) of the edge portion (12) of the outlet component (4) rests, in the assembled state, against the end edge of the edge portion (8) and against the motor bridge (5) at the lugs (16). The outlet component (4) is provided with impressions (14) in positions corresponding to the impressions (9) in the edge portion (8) of the inlet component (3) These impressions (14) form shoulders (15), which are on a level with the shoulder (13) of the edge portion (12) for abutment against the motor bridge (5) at the lugs (16).

2 Claims, 4 Drawing Sheets

Fig. 1
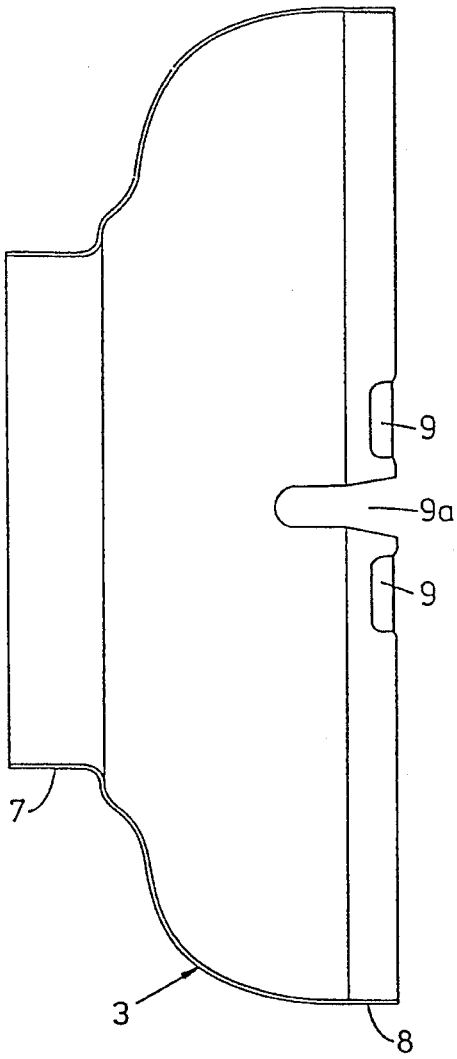
Fig. 2
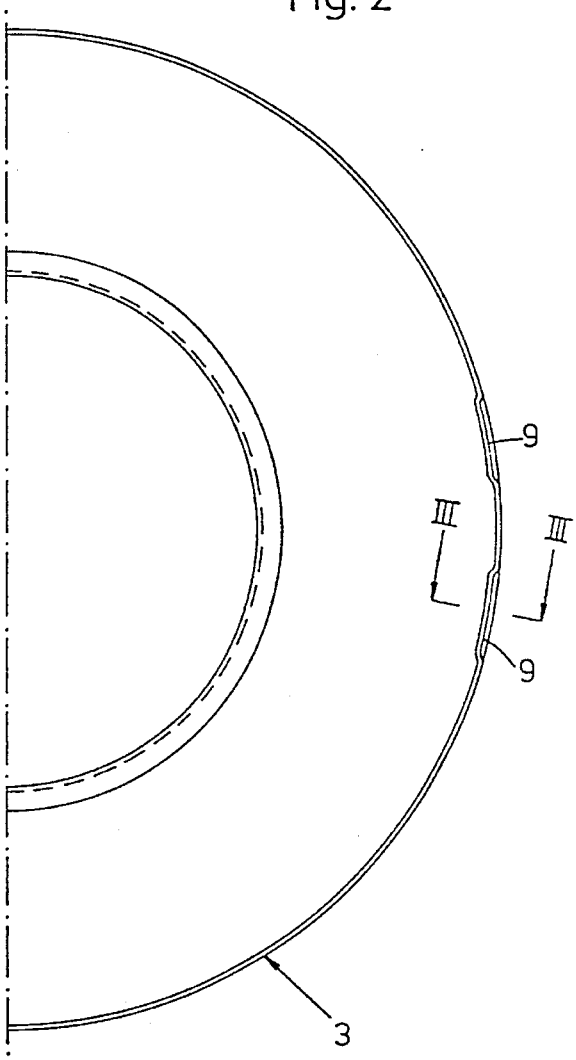
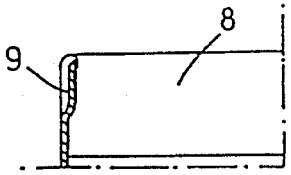
Fig. 3

Fig. 5
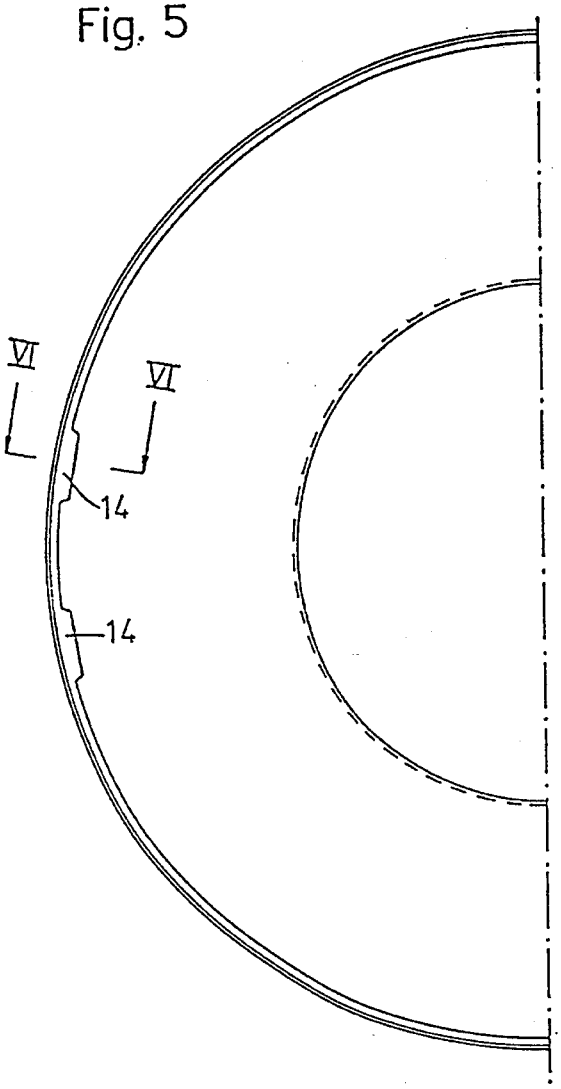
Fig. 4
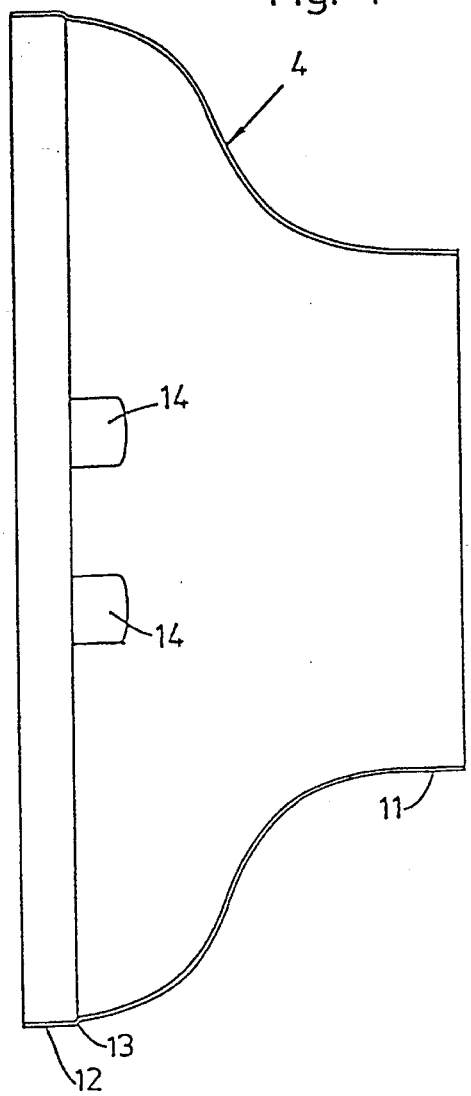
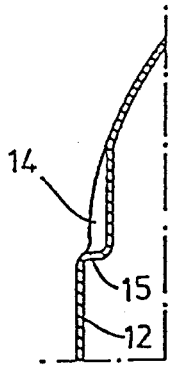
Fig. 6

DUCT FAN HOUSING ASSEMBLY

BACKGROUND OF THE INVENTION

1. Field of the Invention

The present invention refers to duct fans of the type having a radial impeller, and more specifically to a housing for such duct fans, which housing is easy to assemble and, which, merely through the assembly, firmly secures the motor bridge to the fan motor mounted thereon, as well as its radial impeller in its proper place within the housing.

2. Description of the Prior Art

Duct fans are extensively used, e.g. in ventilation and air-conditioning systems in homes, offices and industrial plants, as well as in evacuation systems for toilets, shower rooms and other wet or damp spaces. In connection herewith, duct fans are easy to install in appropriate places within the various ducts, a fact contributing to the relatively extensive use of such fans. In connection herewith, the cost, however, is a limiting factor. It is thus desirable to produce these duct fans with a maximum efficiency in order to achieve a minimum cost without, however, having to lower the standards of quality or function.

A duct fan housing comprises two substantially funnel- or bell-shaped components, one of the components having an air inlet and the other one of the components having an air outlet. The inlet and the outlet are provided in the form of connecting sleeves adapted to connecting standard ventilating ducts. The two components are designed such that one of them fits onto the other across a distance at the wider ends of the components, and screws or rivets are inserted through the overlapping portions to keep the components together. Prior to the assembly, the motor and its accompanying fan generator are placed in one of the components and secured therein by means of a motor bridge extending diagonally across the components and being secured in place through a screw or rivet joint.

Today, once the components have been fitted to one another, manual work is required to secure the components together through a screw or rivet joint or the like. Manual labor is however so expensive, that efforts are made in every possible way to reduce the need therefor. Drilling and screw or rivet joining may be carried out by robots, but when keeping in mind that the remaining assembly work also hitherto had to be executed manually, the use of robots exclusively for the assembly operation was never economical.

SUMMARY OF THE INVENTION

The present invention aims at eliminating the problems mentioned above. This object will be achieved with a duct fan housing of the kind set forth in the patent claims, which also state the characterizing features of the invention.

BRIEF DESCRIPTION OF THE DRAWINGS

The invention will now be described more in detail, making reference to the appended drawings, wherein FIG. 1 is a side view of one of the components, the inlet component, of a duct fan housing according to the invention, FIG. 2 is a broken-away view from the wider end of the inlet component shown in FIG. 1, FIG. 3 is a broken-away sectional view taken along the line III—III of FIG. 2, FIG.4 is a side view of the outlet component of a duct fan housing according to the invention, FIG. 5 is a broken-away view from the wider end of the inlet component shown in FIG. 4, FIG. 6 is a broken-away sectional view taken along the line VI—VI of FIG. 5.

DESCRIPTION OF THE PREFERRED EMBODIMENT

Figure 8:
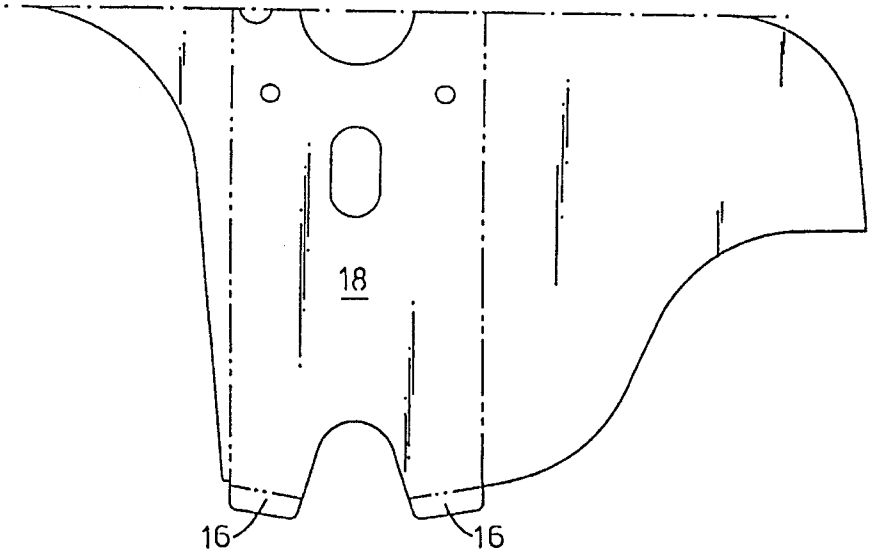
FIG. 8 is a broken-away top view of a blank for a motor bridge according to FIG. 7.
Figure 7:
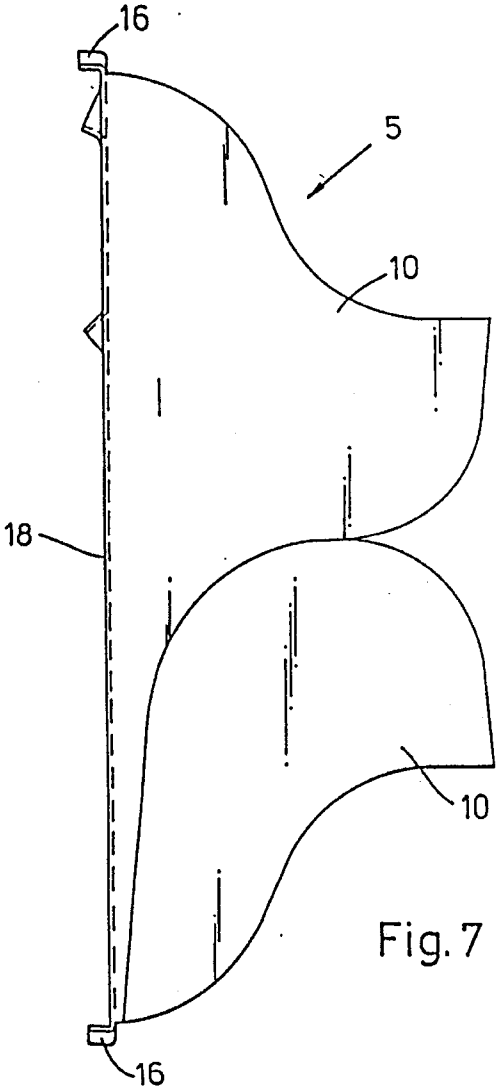
FIG. 7 is a side view of a motor bridge for support of a fan motor and of an accompanying impeller within the fan housing.

A duct fan 1 according to the present invention (see FIG. 9) comprises a duct fan housing 2, which is an assembly of two components, an inlet component 3 and an outlet component 4, a motor bridge 5, which extends diagonally through the housing 2, and a unit 6 secured to the motor bridge 5 and consisting of an external rotor motor having a press-fit impeller.

The inlet component 3 of the duct fan housing 2 comprises a piece, preferably soft sheet metal, having a circular cross section and pressed or drawn to form a funnel shape or bell shape. The inlet component 3 is provided at one of its two ends, axially, with a connecting sleeve 7 having a diameter corresponding to that of a connecting duct. Such connecting sleeves 7 are conventional. Beginning from this connecting sleeve, the diameter increases, whereby the inlet component 3 adopts the substantially conventional funnel shape or bell shape, which provides an optimum efficiency for the duct fan when cooperating with the radially operating impeller. The portion 8 closest to the edge at the wider end of the inlet component 3, see FIG. 1, is preferably cylindrical and has a constant diameter.

In the embodiment shown and described, two pairs of impressions 9 are made in the edge portion 8 (FIG. 1–3), the pairs being diametrically opposed. These impressions 9, which are intended to receive lugs on the motor bridge 5 and thus are adapted to these lugs, are axially extended across approximately half the width of the edge portion 8 from its free edge. A closer description thereof will be made below. A recess **9*a*, extending axially across the entire edge portion 8 and across a distance past this portion, is made between one of the pairs of impressions 9. The recess 9*a* is intended for passing the electrical wire from the motor in the unit 6 through the housing 2** to a conventional terminal box, not shown.

The outlet component 4 of the duct fan housing 2 (FIG. 4–6) is produced in the same way as the inlet component 3 and has the same basic shape. In the assembled state, the outlet component 4 houses wings 10, which project axially from the motor bridge 5 and prevent the air impelled by the radially operating fan from rotating in the outlet component 4 as well as in the following duct, while generating a minimum of air resistance. Thus, it is provided with a connecting sleeve 11 for connecting it to a duct, a funnel- or bell-shaped component and a portion 12 adjacent to the edge at the wider end, which portion preferably is cylindrical and has a substantially constant diameter. The portion 12 is designed to be attached with a close fit onto the portion 8 on the inlet component 3. In order to arrange the components 3 and 4 in a mutually correct manner as they are assembled, a shoulder 13 is preferably provided at the axially inner part of the portion 12, which shoulder is capable of resting against the axial edge on the portion 8, when the components 3 and 4 have been fitted to each other. At the same time, a supplementary sealing function will be obtained, since the shoulder 13 and the edge of the portion 8 contact each other.

Figure 10:
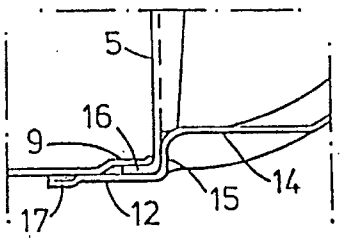
FIG. 10 is a broken-away enlarged sectional view taken within the circle X of FIG. 9.

The portion 12 is preferably provided with a short outer portion 17 having a somewhat larger diameter than that of the rest of the portion 12, see FIG. 10. This portion 17 serves to facilitate the guiding of the outlet component 4 onto the inlet component 3 when assembling the inlet and outlet components 3, 4.

In the outlet component 4, two pairs of diametrically opposing impressions are provided, which extend from the shoulder 13 towards the connecting sleeves 11. On one hand, these impressions are adapted to the position of the impressions 9 in the inlet component 3 so as to coincide therewith, and on the other hand, they are designed so as to form a strong step or shoulder 15 on a level with the shoulder 13. The steps 15 are provided to keep the motor bridge 5 in place in a way, which will be described below.

The motor bridge 5 consists of a substantially rectangular portion 18 provided at either short end with a pair of angularly deflected lugs 16, which are adapted to be placed in the impressions 9 in the inlet component 3. Further, various mounting holes for the motor and impeller unit 6, for wiring arrangements and the like are provided in the rectangular portion 18. A pair of wings 10 project in a direction opposite of that of the lugs 16 from either longitudinal side of the rectangular portion 18, the shape of the wings corresponding to the bell-shaped portion of the outlet component 4, which portion, as previously mentioned, houses these wings.

FIG. 8 illustrates the shape of the motor bridge 5 blank prior to the bending of the wings 10 and the lugs 16, respectively.

Figure 9:
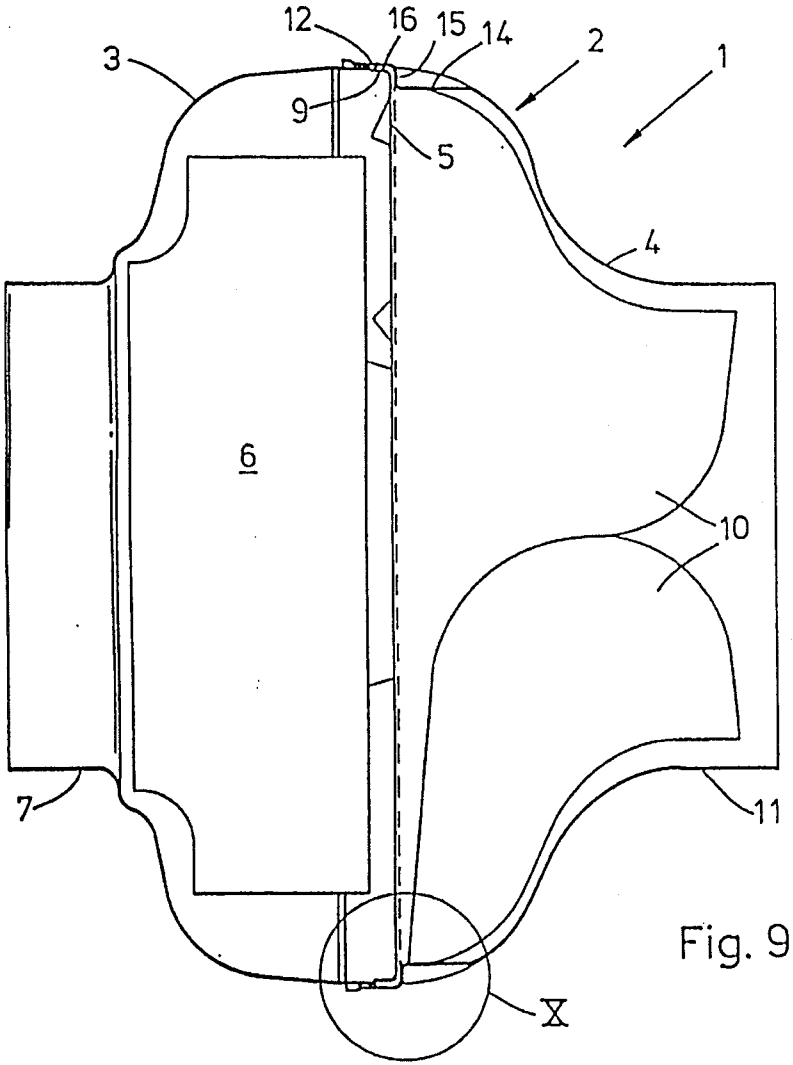
FIG. 9 is a diagrammatic sectional view of a fan housing according to the invention comprising a motor bridge, to which a motor and an accompanying impeller is secured.

FIG. 9 and 10 illustrates the structure of the duct fan 1. In the assembly operation, which preferably will be carried out mechanically, e.g. by means of robots, a motor bridge having a unit 6 comprising motor and impeller attached thereto will be placed onto an inlet component 3, the wider end of which then will be facing upwards. Then, the lugs 16 on the motor bridge 5 will be fitted into the impressions 9 in the edge portion 8 of the inlet component 3, while the unit 6 will be housed within the inlet component, this implying that the unit 6 suspended at this time from the motor bridge 5 by its own weight will keep the motor bridge 5 in place in relation to the inlet component 3. This being the case, these parts will be arranged in a correct interrelation. Then, the outlet component 4 will be fitted with its edge portion 12 onto the edge portion 8 on the inlet component 3. At this time, the impressions 14 will be guided in place against the impressions 9 in the inlet component 3. The components 3, 4 will then be pressed against each other, the shoulders 15 formed through the impressions 14 in their turn being pressed against the motor bridge 5 at the lugs 16, whereby the motor bridge 5 and thus the motor and fan unit 6 will be secured in place. The two components 3, 4 will then be fixed to each other while pressed against each other in any appropriate way, e.g. through insertion of self-drilling and self-tapping screws, riveting or the like, this, too, preferably being carried out mechanically.

By means of the present invention, the object set forth in the beginning of providing a simple, easily assembled and inexpensive duct fan has been achieved. Naturally, a specialist of the art will realize, that various modifications of the present invention are possible, these modifications, however, being intended to lie within the scope of the appended patent claims.

I claim:

1. A duct fan (1) comprising a fan housing (2) assembled by an inlet component (3) and an outlet component (4), which are substantially funnel- or bell-shaped, and a motor bridge (5) placed within the housing (2) and having a unit consisting of a motor with radial impeller (6) secured thereon, the motor bridge (5), which has a substantially rectangular shape and which is extended diametrically through the housing (2), being provided with lugs (16) at its short ends, an edge portion (8) of the inlet component (3) at the wider end thereof, which portion is received in an edge portion (12) of the outlet component (4) at the wider end thereof, being provided with first impressions (9) for receiving the lugs (16) of the motor bridge (5), and the outlet component (4) being provided with second impressions (14) in positions corresponding to the first impressions (9) in the edge portion (8) of the inlet component (3), which second impressions (14) form first shoulders (15) for abutment against the motor bridge (5) at the lugs (16), which first shoulders (15) are on the same diameter of the outlet component (4) as a second shoulder (13) of the edge portion (12) of the outlet component (4), which second shoulder rests against the end edge of the edge portion (8) when the inlet and outlet components (3, 4) are assembled.

2. The duct fan (1) according to claim 1, wherein the edge portion (12) of the outlet component (4) is provided at its free edge with a portion (17) having a larger diameter than a the rest of the edge portion (12).

* * * * *